United States Patent [19]

Madden

[11] Patent Number: 4,928,961

[45] Date of Patent: May 29, 1990

[54] WEIGHT LIFTING APPARATUS

[76] Inventor: Raymond Madden, 222 Woodcroft Rd., Baden, Pa. 15005

[21] Appl. No.: 252,163

[22] Filed: Sep. 30, 1988

[51] Int. Cl.[5] ..... A63B 13/00

[52] U.S. Cl. ..... 272/123; 272/117

[58] Field of Search ..... 272/93, 116, 103, 109, 272/117, 118, 123, 134, 143, 144, DIG. 4; 248/322, 325, 327, 339, 341

[56] References Cited

U.S. PATENT DOCUMENTS

| | | | |
|---|---|---|---|
| 2,452,120 | 10/1948 | Gorne | 248/341 |
| 3,185,422 | 5/1965 | Spindler | 248/341 X |
| 3,435,955 | 4/1969 | Brunette | 248/341 X |
| 3,469,710 | 9/1969 | Vosbikian | 248/341 X |
| 4,216,959 | 8/1980 | Niles | 272/123 |
| 4,231,570 | 11/1980 | Reis | 272/123 |
| 4,249,726 | 2/1981 | Faust | 272/123 |
| 4,368,884 | 1/1983 | Colvin | 272/123 |
| 4,411,425 | 10/1983 | Miler | 272/123 |
| 4,635,930 | 1/1987 | Cormier | 272/123 |
| 4,709,922 | 12/1987 | Slade, Jr. et al. | 272/123 |

*Primary Examiner*—Robert W. Bahr

*Attorney, Agent, or Firm*—Buchanan Ingersoll; Lynn J. Alstadt

[57] ABSTRACT

A weight lifting apparatus for holding a barbell for regular bench press exercises and lock out exercise has a pair of sides positioned to accommodate a bench press therebetween. Each side has a base and a top separated by at least one upright. A hook having a mouth of sufficient size to hold one end of the barbell at a point within the mouth is pivotably attached to the top so that the point will move through an arc when the hook is pivoted, said arc being created when a lifter moves a barbell from a position above his eyes to a position directly above his shoulders. Adjustable lock-out bars are attached to the upright so that they can be positioned to permit lock-out exercises.

14 Claims, 3 Drawing Sheets

WEIGHT LIFTING APPARATUS

FIELD OF THE INVENTION

This invention relates to a weight lifting apparatus for holding a barbell for bench press exercises.

DESCRIPTION OF THE PRIOR ART

In doing bench press exercises the lifter lays on his back on a padded bench. A barbell is held above the bench at its opposite ends by two individuals called spotters or is held on a fixed rack. Typically, the lifter positions himself so that the bar is directly above his eyes. To exercise, the lifter grasps the bar and lifts it off the support or from the spotters to a position directly above his shoulders. He then raises and lowers the barbell over his chest. After completing the desired number of lifts he then must raise the bar over his chest and move it onto the supports or the spotters must grasp the end of the barbell and take it from the lifter.

Extending the arms to move a barbell to and from a position above the eyes creates strain on arm and shoulder muscles rather than building the muscles. Therefore, it would be preferable for the lifter to receive the barbell from a position above his shoulders and release it by lowering the bar to a lower position where support hooks have swung automatically by the force of gravity.

The art has proposed the use of barbell support posts which are attached to the floor and hinged to allow the posts to tilt forward toward the lifter. This device will allow the lifter to receive the barbell from a position above his shoulders. One problem with this type of device is that the barbell could fall off the supports onto the lifter. Another deficiency is that to replace the barbell onto the supports the lifter must lift the barbell to a position that is higher than the point where he removed the barbell from the supports.

Some have attempted to connect a motor to barbell support arms. The motor moves the barbell into position above the shoulders and then retracts the arms. The device is relatively expensive and requires an electrical power source. It is also awkward to operate because the lifter must somehow activate a switch as he begins his lift. However, competition rules and standard lifting techniques normally require the lifter to firmly grasp the bar with both hands and have both feet planted in position on the floor before the lift begins. Neither the hands nor the feet should be moved until the lift is completed.

Use of two spotters is the most common method in which the lifter is able to receive and release the barbell from a position above his shoulders when using poundage near maximum. Typically, each person grasps one end of the barbell and positions or receives the barbell above the lifter's shoulders. However, spotters are not always available. Many people for one reason or another exercise alone. Even if exercising is done in a gym where spotters are available they might not be at immediate standby attention which is most desirable. When the lifter is assisted by spotters who hand him the barbell, it is common for them to present the bar at an angle or for one spotter to release or grasp the barbell before the other spotter does so. This causes uneven weight distribution which strains muscles. Consequently, there is a need for a device which permits even release of a barbell from a position above the lifter's shoulders.

The art has recognized that a ligter can tire and become unable to lift a barbell from his chest. Prolonged resting of a heavy weight on the chest will cause serious injury.

To prevent weights from falling onto or resting on the chest of the lifter, the art has proposed various safety devices or mechanical substitutes for spotters. U.S. Pat. No. 4,411,425 to Milner discloses two adjustable bar supporting members having V-shaped rests to receive the barbell. Two support members are attached to either side of the bench at a position above the lower chest of the lifter. While the support provides some safety, it requires that the weight lifter have sufficient strength and control to reach forward and maneuver the barbell into the V-shaped receptacles. In an emergency situation where the lifter has exhausted his strength, the supports of Milner would not serve as a substitute for a spotter.

U.S. Pat. No. 4,213,570 to Reis discloses two safety bars which are attached to the upright weight supports and angled down to the side of the bench to prevent the weight lifter from dropping the weights on his chest. The safety bars as disclosed require the lifter to position his arms on the outside of the safety bars when lifting the weights which may impede the exercise process. Additionally, when the lifter loses control or becomes suddenly exhausted or cramped the lifter will have to exert backward pressure to prevent the weights from rolling down the incline and damaging the lower chest or pelvic area.

U.S. Pat. No. 4,368,884 to Colvin describes a safety device which fits about the upper end of the weight bench and has vertically adjustable members for catching the outer portion of the bar. These members rest on telescoping legs that have a series of holes through which a pin may pass to hold the catch at a desired position. No other adjustment mechanisms are described. Although the adjustment means described by Colvin is acceptable, it would be preferable to have safety members which could be adjusted by a single movement of the hand or foot.

U.S. Pat. No. 4,635,930 to Cormier discloses two vertical side support members which are attached on either side of and parallel to the bench press. The upper surface of the support members are configured to provide an inclined portion which inclines upwardly away from the shoulders of the weight lifter towards the foot and terminates in a holding portion which is provided with a retainer member which functions to hold the barbell in a fixed position. He uses the same mechanism as Colvin to adjust the height of the retainer members. Cormier also discloses a standard rack for holding the barbell before exercising is begun. He anticipates the spotters will lift the barbell from the support rack to the lifter or that the weight lifter will move the barbell from the uprights to the side supports and then crawl underneath the bar to begin exercising. Neither procedure is desirable for the reasons stated above.

I have learned that certain muscle groups can be strengthened through partial lift exercises I will call lockouts. To perform the exercises the lifter fully extends his arms so that the barbell is above his shoulders. Then, he lowers the barbell some distance less than to his chest and raises it again. This type of exercise can be easily done if lock out bars are provided on the gym which prevent the barbell from being lowered completely onto the chest. The lock out bars should be adjustable to accommodate lifters of all sizes and to allow a variety of partial lifts. Prior to the present invention, the art has not taught or suggested the use of support bars for partial lift exercises. Most, if not all, the safety bars of the prior art are not suited for partial lift exercises.

Consequently, there is a need for an exercise device for bench press exercises that will release the barbell from a position above the lifter's shoulders. The device should incorporate support bars to permit partial lift exercises. The device should be easy to operate and adaptable for both home use and use in a gym.

SUMMARY OF THE INVENTION

I provide a bench press apparatus having a pair of sides positioned generally parallel to one another and spaced apart so that a weight lifting bench may be placed between them. Each side has a base, a top, at least one upright attached to and between the base and the top and a hook having a mouth of sufficient size to hold one end of the barbell. The hook is pivotably attached to the top. The hook is sized and positioned to hold the barbell above the eyes of the lifter and then permit the hook to pivot to position the barbell above the lifter's shoulders. The lifter then lifts the barbell from the hook which retracts to permit the lifter to exercise without being impeded by the hook. I prefer to provide means for adjusting the height of the hook. In one embodiment, a plate with a series of holes is provided, a retaining pin passes through a selected hole into the hook to hold it in the desired position. In another embodiment I provide a slotted plate having slots adapted to receive a pin passing through the hook. Each adjacent slot is sized so that movement of the retaining pin and the hook from one slot to another raises or lowers the position of the hook.

I further prefer to provide adjustable lock out bars in each side. These lock out bars are positioned to permit partial lift exercises by preventing the barbell from being lowered onto the chest of the lifter. The lock out bar may be a simple rod passing through a selected pair of holes in the uprights. This bar may also be supported on telescopic legs having holes therethrough and a retaining pin to hold the bar at a desired height. In still another embodiment of the lock out bar, I provide a tab at the base of a leg which extends from the bar. The tab is sized to fit within a selected slot in a plate having a series of slots. The slots are positioned so that movement of the tab from one slot to an adjacent slot raises or lowers the position of the lock out bar.

I also prefer to provide a back which is attached between and separates the two sides. Preferably, the sides are connected to the back by hinges which permit my device to be folded into a compact structure for quick storage. Other objects and advantages of the invention will become apparent as the following description of certain present preferred embodiments thereof proceeds. In the accompanying drawings I have shown certain present preferred embodiments of the invention.

DESCRIPTION OF THE PREFERRED EMBODIMENTS

Figure 1:
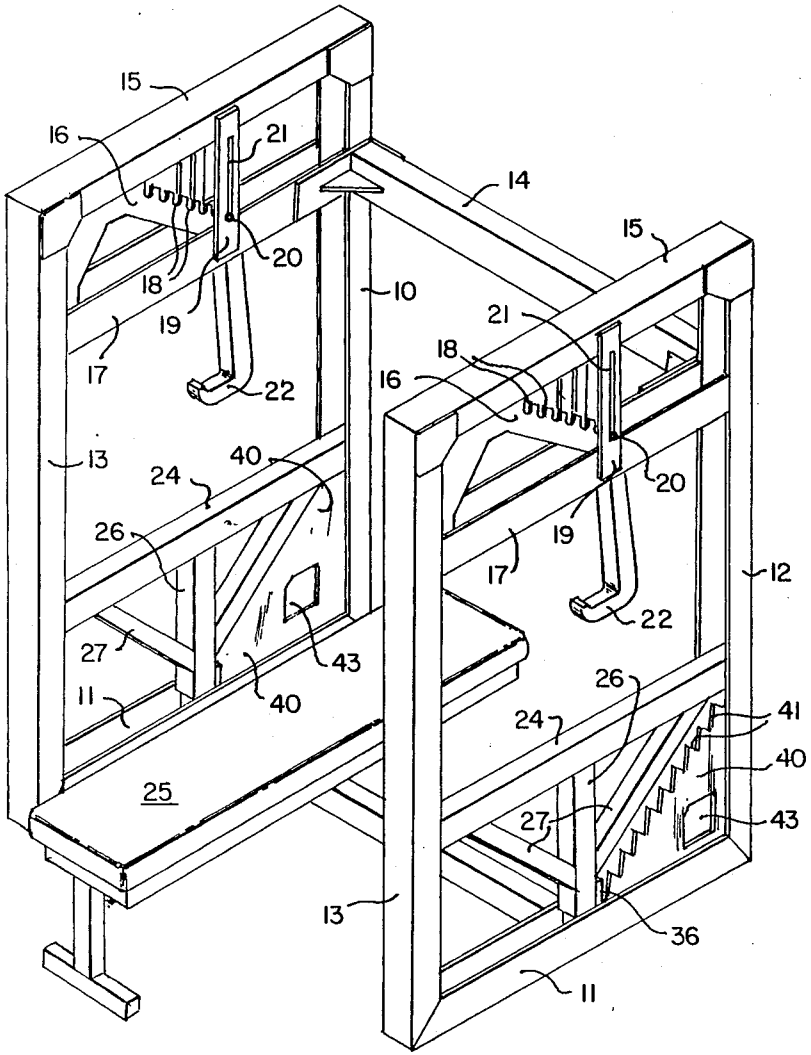
FIG. 1 is an isometric view of a present preferred embodiment of my weight lighting apparatus.

Referring to FIG. 1, my weight lifting apparatus has two sides 10 and 12 which are positioned substantially parallel to one another and separated by back 14. Each side has a base 11 which preferably is a U-shaped channel. Uprights 13 hold top 15 a desired distance above the base. I prefer to provide a hook support member 17 which is preferably a U-shaped channel parallel to top 15. Although I prefer to make base 11 and channel 17 from U-shaped channel, these pieces could have a square, rectangular or other cross-section shape. A plate 19 having slot 21 is connected between top 15 and hook support member 17. Slot 21 is sized to receive a pivot pin 20 which extends from the top of hook 22. Within the channel I prefer to provide an adjustment means 16 having a series of slots 18. The slots are sized and positioned to receive pin 20. As adjustment means 16 are moved from one side to another, pin 20 is moved from slot to slot. As the pin is moved from one slot to an adjacent slot the hook 22 will be raised or lowered.

Figure 3:
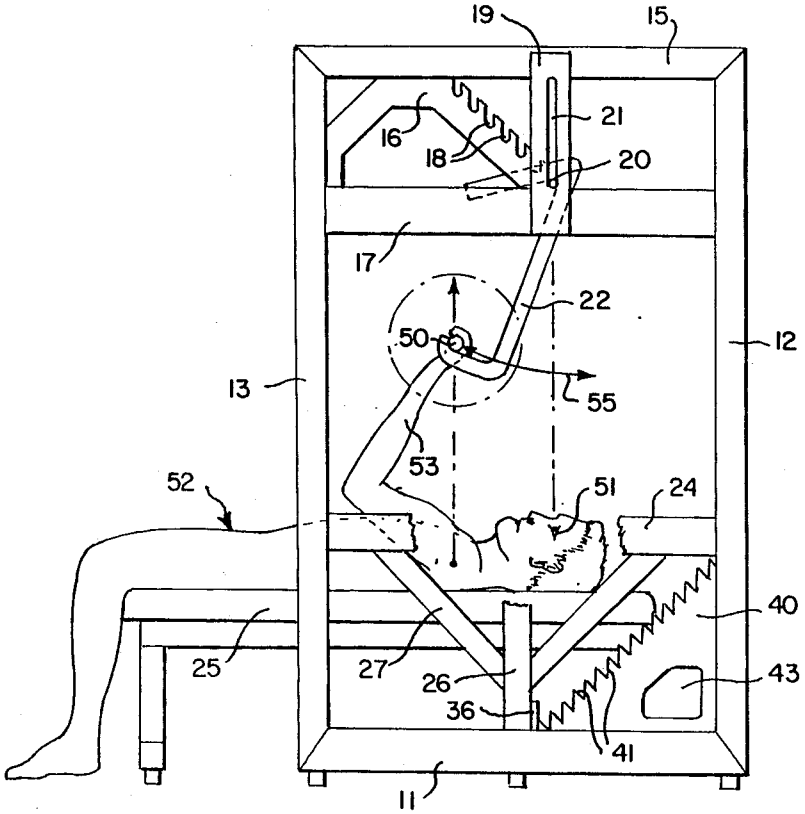
FIG. 3 is a side view similar to FIG. 2 wherein the support hook has been moved to position the barbell above the shoulders of a lifter.
Figure 2:
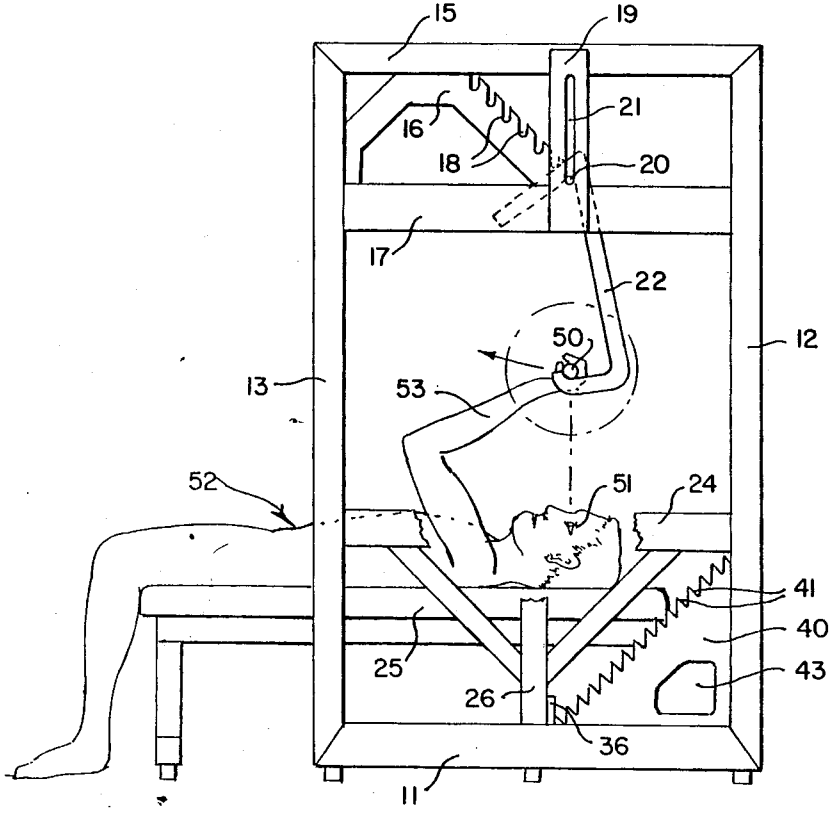
FIG. 2 is a side view of the apparatus of FIG. 1 showing the support hook in its initial position.

Turning to FIGS. 2 and 3, hook 22 is positioned or counterbalanced to be in a rest position as shown in FIG. 2. At this point, a barbell comprised of bar 50 and weights shown in chain line will be positioned so that it is directly above the eye 51 of lifter 52. The lifter extends his arms 53 up to grasp bar 50. As shown in FIG. 2, it is necessary for the lifter to bend and stretch his arm above his head. The lifter grasps bar and moves his arms so as to be perpendicular with his body. As he does this, hook 22 pivots to the position shown in FIG. 3 where bar 50 is above the lifter's shoulders. Arrow 55 indicates the arc through which bar 50 has passed. That arc begins with a point directly above the lifter's eye and terminates with a point directly above the lifter's shoulder. When bar 50 is above the lifter's shoulders he lifts the bar from hooks 22. The hooks 22 then move back to their original position of FIG. 2 allowing the lifter to exercise without obstruction. When he completes his exercise, the lifter returns the bar 50 to hooks 22. The hooks 22 are attached in a manner so that they will not rotate around a vertical axis which rotation would make it difficult to return the bar 50 to the hooks 22.

Figure 5:
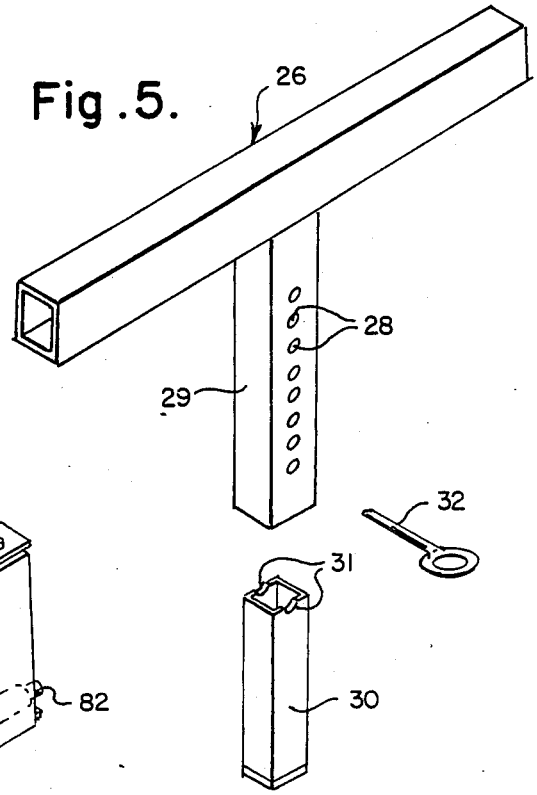
FIG. 5 is detailed view showing a present preferred embodiment of the lock out bar included with the apparatus of FIG. 4.

I also prefer to provide a lock out bar 24 whose height may be adjusted in one of several ways depending upon the construction of the bar. This bar is positioned at heights so that it will permit partial lift exercises. Secondly, the lock out bars may act as safety bars for regular bench pressing by preventing a barbell from falling onto a lifter laying on bench 25. The bar may be a simple rod which passes through holes in uprights 13. It may also be a bar having a telescoping leg 26 extending therefrom. Preferably, supports 27 are provided between bar 24 and leg 26. As shown in FIGS. 1, 2, 3 and 7, there a tab 36 is provided at the base of leg 26. Plate 40 is placed in base channel 11. A series of slots 41 are provided in base 40 which are sized to receive tab 36. As the support plate 40 is moved through the U-shaped channel 11, tab 36 moves from one slot 41 to another. As the tab moves from one slot to an adjacent slot the lock out bar is raised or lowered. I prefer to cut angles in slots 41 and on tab 36 so that tab 36 will always be forced to seat in one of the slots. I further prefer to provide a foot hole 43 which enables support plate 40 to be easily moved through base channel 11. The telescoping leg 26 also may be sized and configured as shown in detail in FIG. 5. Support leg 26 has an upper half 29 and lower half 30. A series of holes 28 are provided in upper half 29. These holes are sized to receive pin 32. A curved seat 31 is provided at the top of leg portion 30 which will support pin 32. Alternatively, one could provide a series of corresponding holes in leg portion 30 through which pin 32 may pass.

Figure 4:
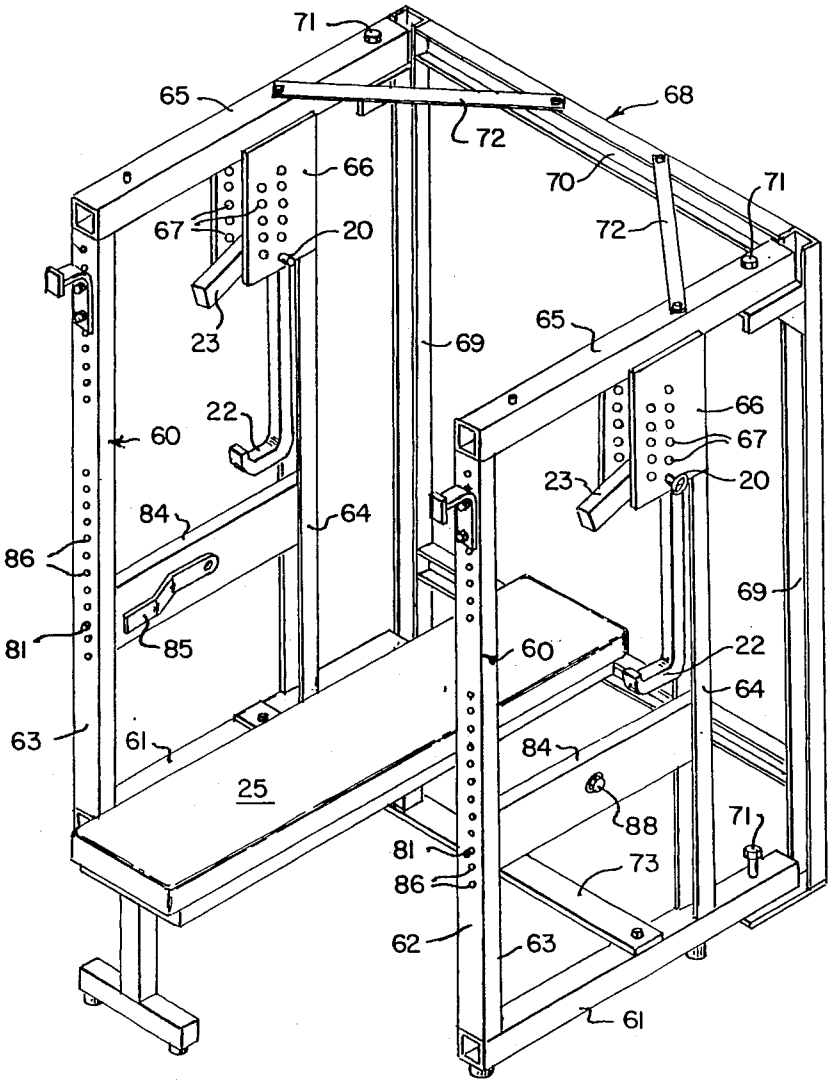
FIG. 4 is an isometric view of a second preferred embodiment of my weight lifting apparatus.
Figure 6:
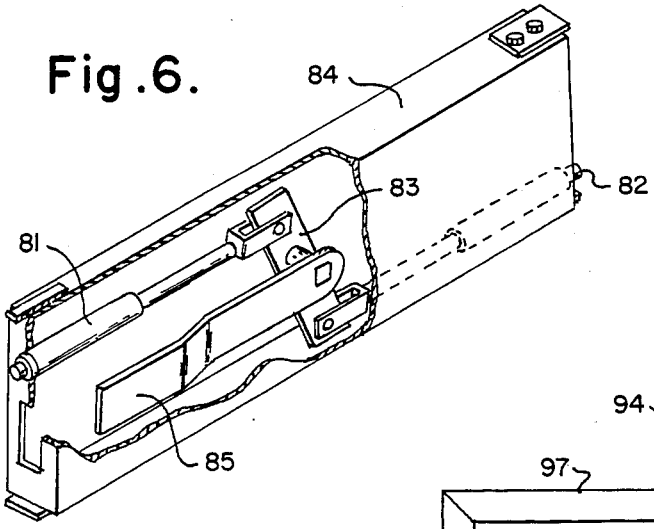
FIG. 6 is an isometric view of the lock-out bar of the embodiment of FIG. 4 partially cut away.

Another embodiment of the lock-out bar is shown in FIGS. 4 and 6. This bar 84 has a pair of locking pins 81 and 82 connected to bar 83 which pivots about post 88 shown in FIG. 2. Handle 85 is connected to bar 83 so that movement of the handle causes pins 81 and 82 to extend into or retract from holes 86 in uprights 62 and 63.

A second present preferred embodiment of my apparatus particularly adapted for home use is shown in FIG. 4. This embodiment contains two parallel sides 60 having base channels 61, uprights 62 and 63 and top 65. In this embodiment, I provide at least one plate 66 having a series of spaced apart holes 67. Hook 22 is provided with a pivot pin 20 that can be removed and inserted through a selected hole 67. I also provide a counterbalance 23 for hook 22. This assures that the hook will return to rest position shown in FIG. 2 after the lifter removes barbell 50 from the hooks. In this embodiment, I also connect sides 60 to back 68 by pivot pins 71. This enables sides 60 to be folded against back 64 for quick storage. In this embodiment I also prefer to provide top braces 72 and bottom brace 73.

Figure 7:
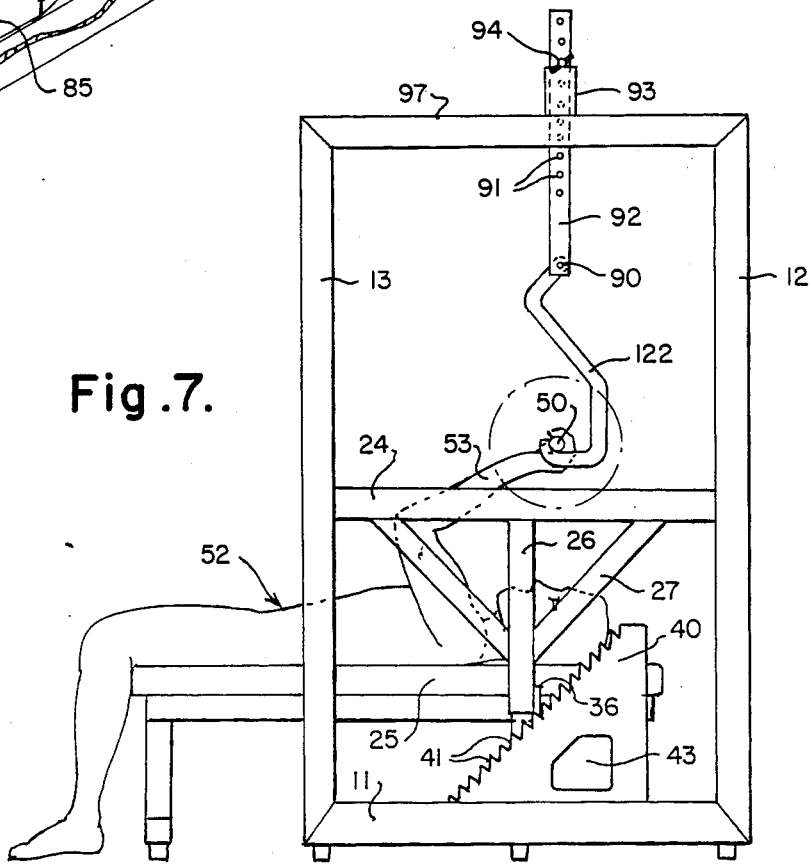
FIG. 7 is a side view of the apparatus of FIG. 1 showing a second preferred support hook and lock-out bars in a raised position.

In FIG. 7 I have modified the embodiment of FIG. 1 to include a third preferred hook and alternative means for mounting the hook. In this embodiment, hook 122 is hung from pin 90 passing through arm 92. Arm 92 is fitted through sleeve 93 which is welded to top 97. Holes 91 are provided in arm 92 which are sized to receive retaining pin 94. Thus, the height of the hook 122 can be changed by moving pin 94 to another hole 91. Hook 122 is shaped in a manner so that when it is freely hung from pin 90 the hook will be balanced to a retracted position which corresponds to the position of hook 22 in FIG. 2. I have found that when hook 122 is shaped as shown in FIG. 7, it will be balanced to the retracted position whether a bar 50 is resting or not resting on the hook 122.

The lock-out bar 21 shown in FIG. 7 is the same as that shown in FIG. 1. However, the lock-out bar 24 has been raised to a position which permits lock-out exercises. In this position support plate 40 has been moved to hold lock-out bar 24 in the raised position. As plate 40 was moved, tab 36 advanced to another slot 41 as shown.

Although I have shown and described certain present preferred embodiments of my weight lifting apparatus, it should be distinctly understood that my invention is not limited thereto, but may be variously embodied within the scope of the following claims.

I claim:

1. A bench press apparatus comprised of a back and a pair of sides attached to the back each side comprised of:

a. a base;
b. a top;
c. at least one upright attached to and between the base and the top; and
d. a hook having a mouth of sufficient size to hold one end of a barbell at a point within the mouth and pivotably attached to the top so that the hook will pivot through a plane which passes through the base and the top and will not rotate about a vertical axis and that the point will move through an arc when the hook is pivoted, said arc being created when a lifter moves a barbell from a position above his eyes to a position directly above his shoulders.

2. The bench press apparatus of claim 1 also comprising a hook support member connected to the uprights below the top, a plate having a slot therethrough extending from the top to the hook support member, and a pivot pin passing through the slot into the hook.

3. The apparatus of claim 2 also comprising adjustment means having a series of slots therein which are sized to that movement of the pivot pin from one slot to an adjacent slot causes the hook to be raised and movement of the pivot pin to an adjacent slot in an opposite direction causes the hook to be lowered, said adjustment means being movably attached to the hook support member.

4. The bench press apparatus of claim 1 also comprising:

a. a sleeve attached to the top;
b. an arm attached to the hook and having at least one hole therethrough sized and positioned to fit through the sleeve;
c. a retaining pin passing through the sleeve; and
d. a pin pressing through the arm and the hook in a manner to pivotably attach the hook to the arm.

5. The bench press apparatus of claim 1 also comprising a lock out bar for each side, each lock out bar connected to the upright of each side and being adjustable to selected positions which permit partial lift exercises by a lifter who is lying on a bench placed between the sides.

6. The bench press apparatus of claim 5 wherein the lock out bar is a rod and the upright is provided with holes through which the rod may pass.

7. The bench press apparatus of claim 5 also comprising a telescoping leg connected between the lock out bar and the base.

8. The bench press apparatus of claim 7 wherein the telescoping leg has a series of holes and also comprising a locking pin sized and positioned to fit through a selected hole in the telescoping leg.

9. The bench press apparatus of claim 5 wherein two uprights having holes therein are provided on each side and the lock-out bars are positioned between the uprights also comprising:

a. a post on the lock-out bar;
b. a pivot bar positioned to pivot about the post,
c. a handle attached to the pivot bar; and
d. at least one pin attached to the pivot bar and being sized and positioned to extend into and retract from a hole in an upright when the pivot bar is pivoted about the post.

10. The bench press apparatus of claim 5 also comprising:

a. a leg extending from the lock-out bar;

b. a tab attached to and extending from the leg at an end opposite the lock-out bar;

c. a support having a series of slots therein which are sized and positioned to receive the tab and movement of the tab from one slot to an adjacent slot causes the lockout bar to be raised and movement of the tab to an adjacent slot in an opposite direction causes the lock-out bar to be lowered, said support being movably attached to the base.

11. The bench apparatus of claim 1 wherein the back is attached to the sides in such a manner that the sides can be folded against the back.

12. The bench apparatus of claim 1 also comprising a counterbalance attached to the hook in such a manner so as to cause the hook to move to a retracted position after a barbell is lifted from it.

13. The bench press apparatus of claim 1 wherein the hook is of a size and shape so as to be counterbalanced to move to a retracted position after a barbell is lifted from it.

14. The bench press apparatus of claim 2 wherein hook support member is a U-shaped channel.

* * * * *

UNITED STATES PATENT AND TRADEMARK OFFICE

CERTIFICATE OF CORRECTION

PATENT NO. : 4,928,961

DATED : May 29, 1990

INVENTOR(S) : RAYMOND MADDEN

It is certified that error appears in the above-identified patent and that said Letters Patent is hereby corrected as shown below:

Column 8, line 4, claim 12, after "bench" insert --press--.

Signed and Sealed this

Seventeenth Day of December, 1991

*Attest:*

HARRY F. MANBECK, JR.

*Attesting Officer*

*Commissioner of Patents and Trademarks*